US007402073B2

(12) United States Patent
Yotsutani

(10) Patent No.: US 7,402,073 B2
(45) Date of Patent: Jul. 22, 2008

(54) CABLE CONNECTOR AND METHOD OF CONNECTING A CABLE WITH A CABLE CONNECTOR

(75) Inventor: Kenichi Yotsutani, Tokyo (JP)

(73) Assignee: I-Pex Co., Ltd., Machida-Shi, Tokyo (JP)

( * ) Notice: Subject to any disclaimer, the term of this patent is extended or adjusted under 35 U.S.C. 154(b) by 0 days.

(21) Appl. No.: 11/592,967

(22) Filed: Nov. 6, 2006

(65) Prior Publication Data

US 2007/0149042 A1 Jun. 28, 2007

(30) Foreign Application Priority Data

Dec. 27, 2005 (JP) ..... 2005-375256

(51) Int. Cl.
*H01R 4/24* (2006.01)

(52) U.S. Cl. ..... 439/394

(58) Field of Classification Search ..... 439/394, 439/404, 405, 497, 579, 417, 395, 492
See application file for complete search history.

(56) References Cited

U.S. PATENT DOCUMENTS

| | | | | |
|---|---|---|---|---|
| 3,573,719 | A * | 4/1971 | Lightner | 439/494 |
| 4,743,208 | A * | 5/1988 | Weisenburger | 439/398 |
| 4,993,968 | A * | 2/1991 | Guletsky et al. | 439/492 |
| 5,192,833 | A * | 3/1993 | Gibson | 174/74 R |
| 6,033,238 | A * | 3/2000 | Fogg et al. | 439/108 |
| 6,093,063 | A * | 7/2000 | Tsuji et al. | 439/752 |
| 6,186,829 | B1 * | 2/2001 | Murakami et al. | 439/587 |
| 6,305,979 | B1 * | 10/2001 | Ko | 439/579 |
| 6,338,652 | B1 * | 1/2002 | Ko | 439/579 |
| 6,371,771 | B1 * | 4/2002 | Fan | 439/79 |
| 6,456,001 | B1 * | 9/2002 | Iida et al. | 313/493 |
| 6,602,089 | B2 * | 8/2003 | Abe et al. | 439/404 |
| 6,685,495 | B1 * | 2/2004 | Ko | 439/353 |
| 6,726,503 | B2 * | 4/2004 | Waddell et al. | 439/465 |
| 6,960,097 | B2 * | 11/2005 | Morishita | 439/404 |
| 7,040,917 | B2 * | 5/2006 | Yagi et al. | 439/495 |

FOREIGN PATENT DOCUMENTS

| | | |
|---|---|---|
| EP | 590796 A2 * | 4/1994 |
| JP | 2001-223039 | 8/2001 |

* cited by examiner

*Primary Examiner*—T. C. Patel
*Assistant Examiner*—Vladimir Imas
(74) *Attorney, Agent, or Firm*—Studebaker & Brackett PC; Donald R. Studebaker

(57) ABSTRACT

A cable connector comprises a housing, a signal conductive contact having a first transformable portion for holding a core conductor of a coaxial cable in a condition of caulking connection, a ground conductive contact having a second transformable portion for holding an outer conductor of the coaxial cable in a condition of caulking connection, and a cover member for engaging with the housing to cover the first transformable portion of the signal conductive contact and the second transformable portion of the ground conductive contact and operating to transform the first transforming portion of the signal conductive contact so as to hold the core conductor of the coaxial cable in the condition of caulking connection and to transform also the second transforming portion of the ground conductive contact so as to hold the outer conductor of the coaxial cable in the condition of caulking connection.

9 Claims, 10 Drawing Sheets

CABLE CONNECTOR AND METHOD OF CONNECTING A CABLE WITH A CABLE CONNECTOR

BACKGROUND OF THE INVENTION

1. Field of the Invention

The present invention relates generally to a cable connector and a method of connecting a cable with a cable connector, and more particularly to an improvement in a cable connector which has signal and ground conductive contacts isolated from each other to be connected respectively with core and outer conductors of a coaxial cable, and an improvement in a method of connecting electrically a coaxial cable having core and outer conductors with a cable connector having signal and ground conductive contacts isolated from each other to be connected respectively with the core and outer conductors of the coaxial cable.

2. Description of the Prior Art

There has been proposed to use often a cable connector with which a coaxial cable, which comprises a core conductor, an outer conductor surrounding the core conductor, an insulating layer provided between the core conductor and the outer conductor and an insulating cover surrounding the outer conductor to form a signal transmitting path unsusceptible to influence of noise, is electrically connected, when electrical parts, electrical devices or electrical apparatus are connected with each other through the coaxial cable so that signal transmissions are carried out through the coaxial cable between the electrical parts, electrical devices or electrical apparatus. The cable connector thus used is provided, for example, with signal and ground conductive contacts isolated from each other, with which the core and outer conductors of the coaxial cable are connected respectively.

In a previously proposed cable connector for a coaxial cable, it is usual to use soldering for connecting electrically the coaxial cable with the cable connector. That is, when the coaxial cable is connected electrically with the cable connector, a core conductor of the coaxial cable is soldered to a signal conductive contact of the cable connector and an outer conductor of the coaxial cable is also soldered to a ground conductive contact of the cable connector.

In the case of the soldering for connecting electrically the coaxial cable with the cable connector, in which the core and outer conductors of the coaxial cable are soldered respectively to the signal and ground conductive contacts of the cable connector, there is a problem that operations for soldering the core and outer conductors of the coaxial cable respectively to the signal and ground conductive contacts of the cable connector are troublesome for an operator or that heat accompanying with the soldering spreads through the coaxial cable to bring about inconveniences. Such a problem is severe especially when a slender coaxial cable having a relatively small diameter is connected electrically with the cable connector or a cable aggregate constituted with a plurality of coaxial cables arranged in parallel with one another to be flat is connected electrically with the cable connector.

Accordingly, it has been desired that a cable connector with which the coaxial cable is connected electrically without using soldering is provided. As for the cable connector with which the coaxial cable is connected electrically without using soldering, there has been previously proposed a cable connector in which the core and outer conductors of the coaxial cable are connected respectively with the signal and ground conductive contacts of the cable connector by means of press-contacting, as disclosed in, for example, the Japanese patent application published before examination under publication number 2001-223039.

In the previously proposed cable connector disclosed in the publication mentioned above, a plurality of signal conductive contacts and a plurality of ground conductive contacts supported by a contact supporting plate member are provided in such a manner that each of the signal and ground conductive contacts is provided with a U-shaped connecting portion at the end thereof or the signal conductive contact is provided with a U-shaped connecting portion at the end thereof and the ground conductive contact is coupled with a pair of catching plates. Then, the coaxial cable is connected electrically with the previously proposed cable connector in such a manner that the core conductor of the coaxial cable is pushed in the U-shaped connecting portion of the signal conductive contact of the cable connector and the outer conductor of the coaxial cable is pushed in the U-shaped connecting portion of the ground conductive contact of the cable connector or the core conductor of the coaxial cable is pushed in the U-shaped connecting portion of the signal conductive contact of the cable connector and the outer conductor of the coaxial cable is put between the catching plates with which the ground conductive contact of the cable connector is coupled. Thereby, the coaxial cable is connected electrically with the cable connector without using soldering in such a manner that the core conductor of the coaxial cable is in press-contact with the U-shaped connecting portion of the signal conductive contact of the cable connector and the outer conductor of the coaxial cable is also in press-contact with the U-shaped connecting portion of the ground conductive contact of the cable connector or the core conductor of the coaxial cable is in press-contact with the U-shaped connecting portion of the signal conductive contact of the cable connector and the outer conductor of the coaxial cable is press-contact with the catching plates with which the ground conductive contact of the cable connector is coupled.

In the above-mentioned previously proposed cable connector in which the core and outer conductors of the coaxial cable are connected respectively with the signal and ground conductive contacts by means of press-contacting, the core conductor of the coaxial cable is connected with the signal conductive contact by pushing the core conductor in the U-shaped portion of the signal conductive contact to come into press-contact with the same and the outer conductor of the coaxial cable is connected with the ground conductive contact by pushing the outer conductor in the U-shaped portion of the ground conductive contact or by putting the outer conductor between the catching plates with which the ground conductive contact is coupled to come into press-contact with the U-shaped portion of the ground conductive contact or the catching plates. In the case that the core conductor of the coaxial cable is connected with the signal conductive contact of the cable connector only by means of press-contacting the core conductor with the U-shaped portion of the signal conductive contact and the outer conductor of the coaxial cable is connected with the ground conductive contact of the cable connector only by means of press-contacting the outer conductor with the U-shaped portion of the ground conductive contact or press-contacting the outer conductor with the catching plates with which the ground conductive contact is coupled, as mentioned above, there is a problem that the connection of the core conductor of the coaxial cable with the signal conductive contact of the cable connector or the connection of the outer conductor of the coaxial cable with the ground conductive contact of the cable connector is lacking in certainty.

For example, it is feared that the core conductor of the coaxial cable is not pushed enough in the U-shaped portion of the signal conductive contact of the cable connector so as to be lifted out of the U-shaped portion of the signal conductive contact and thereby the core conductor of the coaxial cable is uncertainly in press-contact with the U-shaped portion of the signal conductive contact, or the core conductor of the coaxial cable is pushed excessively in the U-shaped portion of the signal conductive contact of the cable connector so as to be partially cut off and thereby the core conductor of the coaxial cable is uncertainly in press-contact with the U-shaped portion of the signal conductive contact. Further, it is further feared that the outer conductor of the coaxial cable is not pushed enough in the U-shaped portion of the ground conductive contact of the cable connector also so as to be lifted out of the U-shaped portion of the ground conductive contact and thereby the outer conductor of the coaxial cable is uncertainly in press-contact with the U-shaped portion of the ground conductive contact. Especially, when an extremely slender coaxial cable having, for example, the diameter of a core conductor of 0.075 mm, the outer diameter of an insulating layer surrounding the core conductor of 0.2 mm, the outer diameter of an outer conductor of 0.26 mm and the outer diameter of an insulating cover surrounding the outer conductor of 0.34 mm is connected electrically with the cable connector by means of press-contacting, it is seriously feared that the extremely slender coaxial cable is partially cut off on the cable connector.

OBJECTS AND SUMMARY OF THE INVENTION

Accordingly, it is an object of the present invention to provide a cable connector having signal and ground conductive contacts isolated from each other to be connected respectively with core and outer conductors of a coaxial cable, which avoids the aforementioned problems and disadvantages encountered with the prior art.

Another object of the present invention is to provide a cable connector having signal and ground conductive contacts isolated from each other to be connected respectively with core and outer conductors of a coaxial cable, in which the core and outer conductors of the coaxial cable can be connected respectively with the signal and ground conductive contacts surely and securely with relatively simple operations without soldering.

A further object of the present invention is to provide a method of connecting electrically a coaxial cable having core and outer conductors with a cable connector having signal and ground conductive contacts isolated from each other to be connected respectively with the core and outer conductors of the coaxial cable, with which the core and outer conductors of the coaxial cable can be connected respectively with the signal and ground conductive contacts of the cable connector surely and securely with relatively simple operations without soldering.

According to a first aspect of the present invention, as claimed in accompanying claims, there is provided a cable connector, which comprises a housing made of insulating material, a signal conductive contact provided in the housing and having a first transformable portion for holding a core conductor of a coaxial cable in a condition of caulking connection, a ground conductive contact provided in the housing and having a second transformable portion for holding an outer conductor of the coaxial cable in a condition of caulking connection, and a cover member for engaging with the housing to cover the first transformable portion of the signal conductive contact and the second transformable portion of the ground conductive contact and operating to transform the first transforming portion of the signal conductive contact so as to hold the core conductor of the coaxial cable in the condition of caulking connection and to transform also the second transforming portion of the ground conductive contact so as to hold the outer conductor of the coaxial cable in the condition of caulking connection.

Further, according to a second aspect of the present invention, as claimed in accompanying claims, there is provided a method of connecting a cable with a cable connector, which comprises the steps of putting core and outer conductors of a coaxial cable respectively on a first transformable portion of a signal conductive contact and a second transformable portion of a ground conductive contact provided in a housing of a cable connector, and causing a cover member to engage with the housing of the cable connector to cover the first transformable portion of the signal conductive contact and the second transformable portion of the ground conductive contact and to be operative to transform the first transforming portion of the signal conductive contact so as to hold the core conductor of the coaxial cable in the condition of caulking connection and to transform also the second transforming portion of the ground conductive contact so as to hold the outer conductor of the coaxial cable in the condition of caulking connection, so that the core and outer conductors of the coaxial cable are electrically connected respectively with the signal and ground conductive contacts of the cable connector.

In the cable connector constituted as described above in accordance with the present invention, the signal and ground conductive contacts provided in the housing have the first and second transformable portions, respectively. The first transformable portion of the signal conductive contact is able to be operative to hold the core conductor of the coaxial cable in the condition of caulking connection and the second transformable portion of the ground conductive contact is able to be operative to hold the outer conductor of the coaxial cable in the condition of caulking connection. The cover member which is provided apart from the housing of the cable connector is operative to engage with the housing to cover the first transformable portion of the signal conductive contact and the second transformable portion of the ground conductive contact. The cover member covering the first transformable portion of the signal conductive contact and the second transformable portion of the ground conductive contact is operative to transform the first transformable portion of the signal conductive contact to hold the core conductor of the coaxial cable in the condition of caulking connection and to transform also the second transformable portion of the ground conductive contact to hold the outer conductor of the coaxial cable in the condition of caulking connection.

Further, in the method carried out as described above in accordance with the present invention, first the core and outer conductors of the coaxial cable are put respectively on the first transformable portion of the signal conductive contact and the second transformable portion of the ground conductive contact provided in the housing of the cable connector. Then, the cover member which is provided apart from the housing of the cable connector is caused to engage with the housing of the cable connector to cover the first transformable portion of the signal conductive contact and the second transformable portion of the ground conductive contact. Thereby, with the cover member covering the first transformable portion of the signal conductive contact and the second transformable portion of the ground conductive contact, first transforming portion of the signal conductive contact is transformed to hold the core conductor of the coaxial cable in the condition of caulking connection and the second transforming portion of the ground conductive contact is also transformed to hold the outer conductor of the coaxial cable in the condition of caulking connection, so that the core and outer conductors of the coaxial cable are electrically connected respectively with the signal and ground conductive contacts of the cable connector.

As explained above, with the cable connector according to the present invention or the method according to the present invention, when the coaxial cable is connected electrically with the cable connector, the core and outer conductors of the coaxial cable can be simultaneously connected with the signal and ground conductive contacts of the cable connector, respectively, by engaging the cover member with the housing of the cable connector. Further, the core conductor of the coaxial cable can be connected with the signal conductive contact of the cable connector with the transformable portion of the signal conductive contact transformed to hold the core conductor in the condition of caulking connection and the outer conductor of the coaxial cable can be connected with the ground conductive contact of the cable connector with the transformable portion of the ground conductive contact transformed to hold the outer conductor in the condition of caulking connection.

The connection of the core conductor of the coaxial cable with the signal conductive contact of the cable connector with the transformable portion of the signal conductive contact transformed to hold the core conductor in the condition of caulking connection is carried out surely and securely, and the connection of the outer conductor of the coaxial cable with the ground conductive contact of the cable connector with the transformable portion of the ground conductive contact transformed to hold the outer conductor in the condition of caulking connection is also carried out surely and securely.

Accordingly, the core and outer conductors of the coaxial cable can be connected respectively with the signal and ground conductive contacts of the cable connector surely and securely with relatively simple operations without soldering.

The above, and other objects, features and advantages of the present invention will become apparent from the following detailed description taken in conjunction with the accompanying drawings.

DESCRIPTION OF THE PREFERRED EMBODIMENTS

An embodiment of cable connector according to the present invention will be explained making reference to FIGS. 1 to 11 and an embodiment of method of connecting a cable with a cable connector according to the present invention will be explained making reference to FIGS. 12 to 21.

Figure 1:
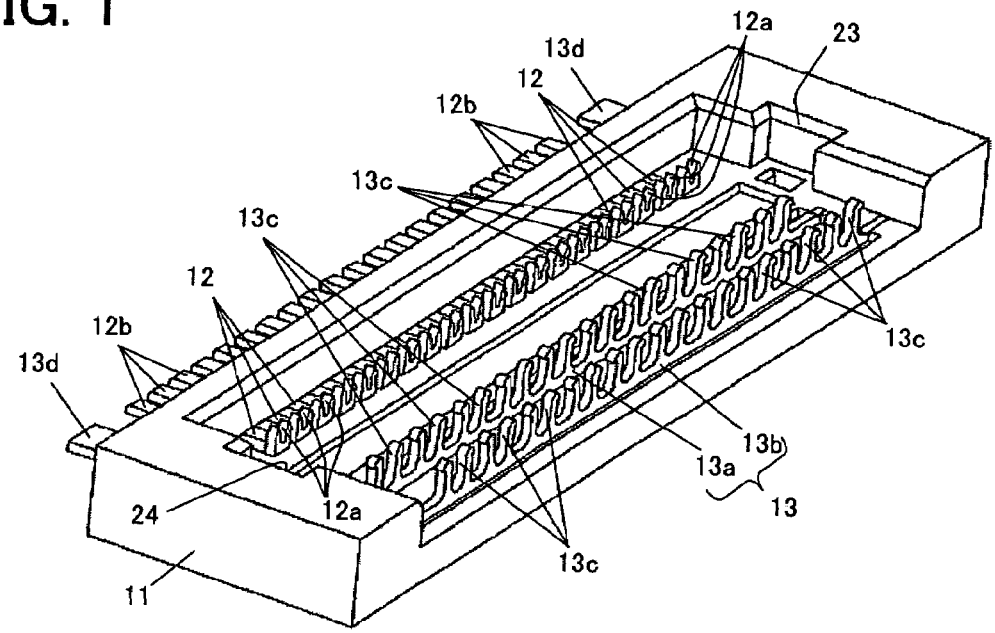
FIG. 1 is a schematic perspective view showing a part of an embodiment of cable connector according to the present invention.
Figure 2:
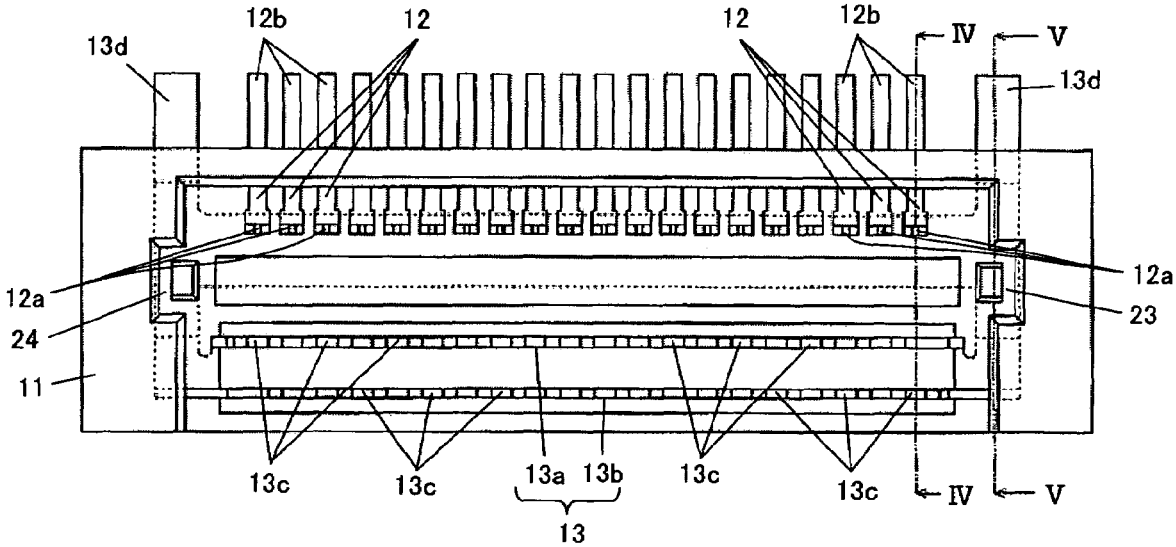
FIG. 2 is a schematic plane view showing the part of the embodiment of cable connector according to the present invention.
Figure 3:
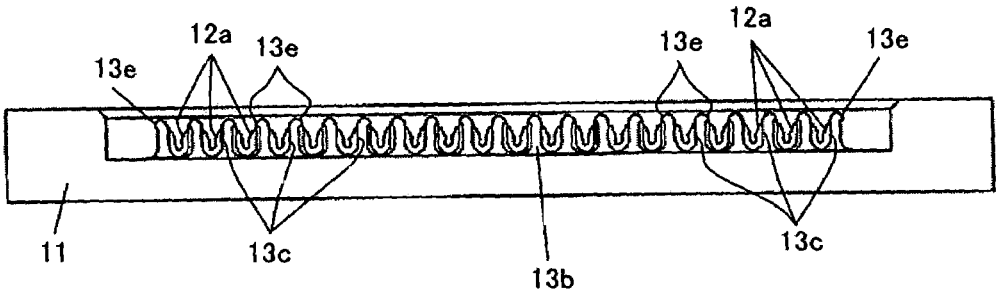
FIG. 3 is a schematic front view showing the part of the embodiment of cable connector according to the present invention.

FIGS. 1, 2 and 3 show a part of the embodiment of cable connector according to the present invention. Referring to FIGS. 1 to 3, the part of the embodiment comprises a housing 11 which is made of insulating material. A plurality of signal conductive contacts 12 each made of conductive material are arranged in the housing 11 and a ground conductive contact 13 made of conducting material to form a first portion 13*a* and a second portion 13*b* is also provided in the housing 11.

Each of the signal conductive contacts 12 has a transformable portion 12*a* which is able to be transformed to hold a core conductor of a coaxial cable in a condition of caulking connection and an external connecting end portion 12*b* which is connected with, for example, an electrical terminal provided on a printed circuit board. A plurality of transformable portions 12*a* are arranged in a line in the housing 11. Each of the first and second portions 13*a* and 13*b* of the ground conductive contacts 13 has a plurality of transformable portions 13*c*, each of which is able to be transformed to hold an outer conductor of a coaxial cable in a condition of caulking connection. The transformable portions 13*c* of the first portion 13*a* of the ground conductive contact 13 are arranged in the housing 11 in a line substantially parallel with the linear arrangement of the transformable portions 12*a* of the signal conductive contacts 12 and the transformable portions 13*c* of the second portion 13*b* of the ground conductive contact 13 are also arranged in the housing 11 in a line substantially parallel with the linear arrangement of the transformable portions 12*a* of the signal conductive contacts 12.

The first and second portions 13*a* and 13*b* are incorporated with each other in the inner part of the housing 11. The ground conductive contact 13 having the first and second portions 13*a* and 13*b* incorporated with each other has further a pair of external connecting end portions 13*d*.

Each of the transformable portions 13*c* of the ground conductive contact 13 is disposed to correspond to the transformable portion 12*a* of one of the signal conductive contacts 12, so that the transformable portion 12*a* of each of the signal conductive contacts 12 and the transformable portion 13*c* of the ground conductive contact 13 corresponding thereto are arranged in a direction substantially perpendicular to the linear arrangement of the transformable portions 12*a* of the signal conductive contacts 12.

Figure 4:
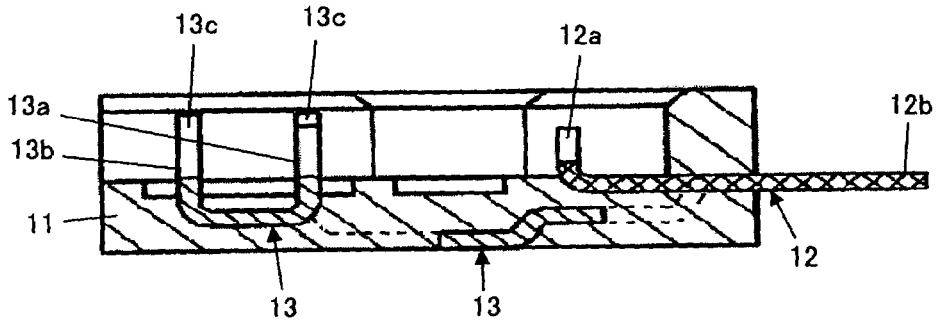
FIG. 4 is a schematic cross sectional view taken along line IV-IV in FIG. 2.
Figure 5:
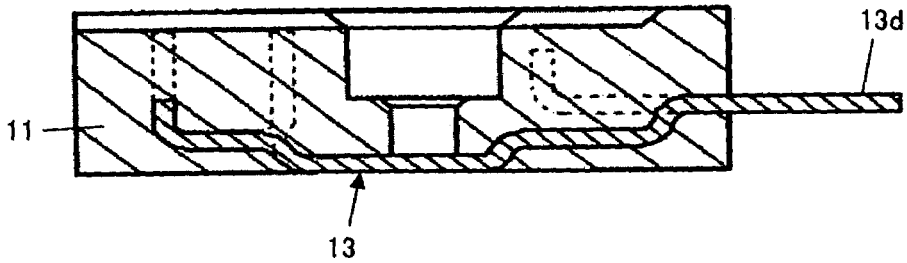
FIG. 5 is a schematic cross sectional view taken along line V-V in FIG. 2.
Figure 6:
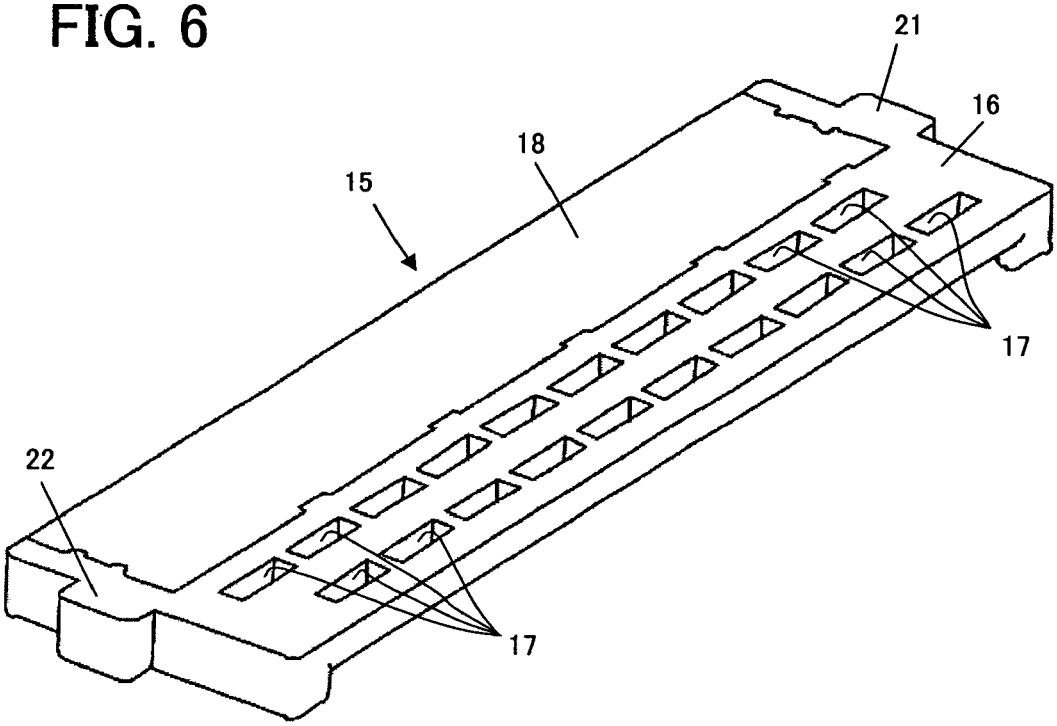
FIG. 6 is a schematic perspective view showing another part of the embodiment of cable connector according to the present invention.

As shown in FIG. 4 representing a cross section along line IV-IV in FIG. 2, a part of the signal conductive contact 12 elongates from the transformable portion 12*a* positioned in the inside of the housing 11 through a part of the housing 11 to the outside of the housing 11 so as to form the external connecting end portion 12*b*. Further, as shown in FIG. 4 and in FIG. 5 representing a cross section along line V-V in FIG. 2, the ground conductive contact 13 has a portion buried in the housing 11 by means of insert-molding and a part of the ground conductive contact 13 elongates from the transformable portion 13*c* positioned in the inside of the housing 11 through a part of the housing 11 to the outside of the housing 11 so as to form the external connecting end portion 13*d*. The signal and ground conductive contacts 12 and 13 thus constituted have the effect of improving electrical shielding on the housing 11 for suppressing noise emission from the signal conductive contacts 12 and excluding outer noise, and is operative to strengthen the housing 11. Since the portion of the ground conductive contact 13 buried in the housing 11 extends to a position below the transformable portion 12*a* of the signal conductive contact 12, the ground conductive contact 13 is especially effective for making resistance to pushing force acting on the housing 11 when the core conductor of the coaxial cable is connected with the transformable portion 12*a* of the signal conductive contacts 12. Although the first portion 13*a*, the second portion 13*b* and the external connecting end portion 13*d* of the ground conductive contact 13 are incorporated with one another in the embodiment shown in FIGS. 1 to 5, it is also possible to form independently the first portion 13*a*, the second portion 13*b* and the external connecting end portion 13*d* of the ground conductive contact 13 to be interconnected electrically.

FIGS. 6 to 9 show a cover member 15 which is to engage with the housing 11 included in the part of the embodiment of cable connector according to the present invention to cover the transformable portions 12*a* of the signal conductive contacts 12 and the transformable portions 13*c* of the ground conductive contact 13. The cover member 15 has a body portion 16 made of insulating material to be shaped into a board in its entirety.

Figure 7:
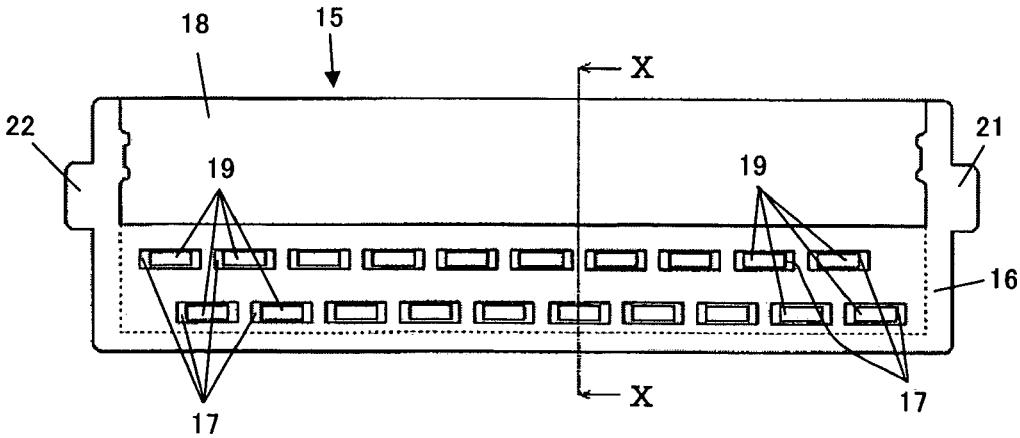
FIG. 7 is a schematic plane view showing another part of the embodiment of cable connector according to the present invention.
Figure 8:
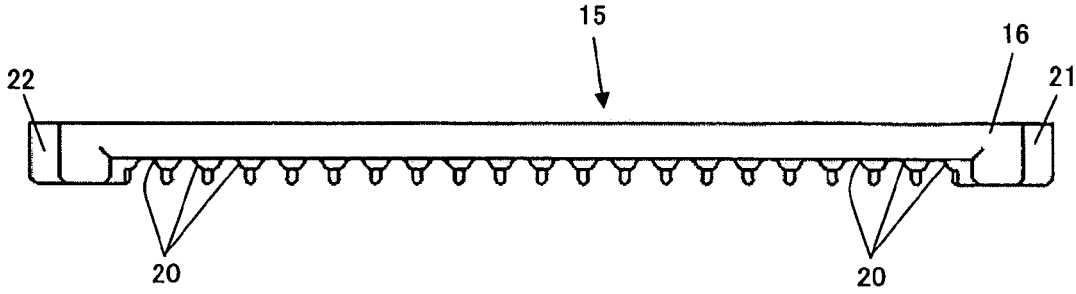
FIG. 8 is a schematic front view showing another part of the embodiment of cable connector according to the present invention.
Figure 9:
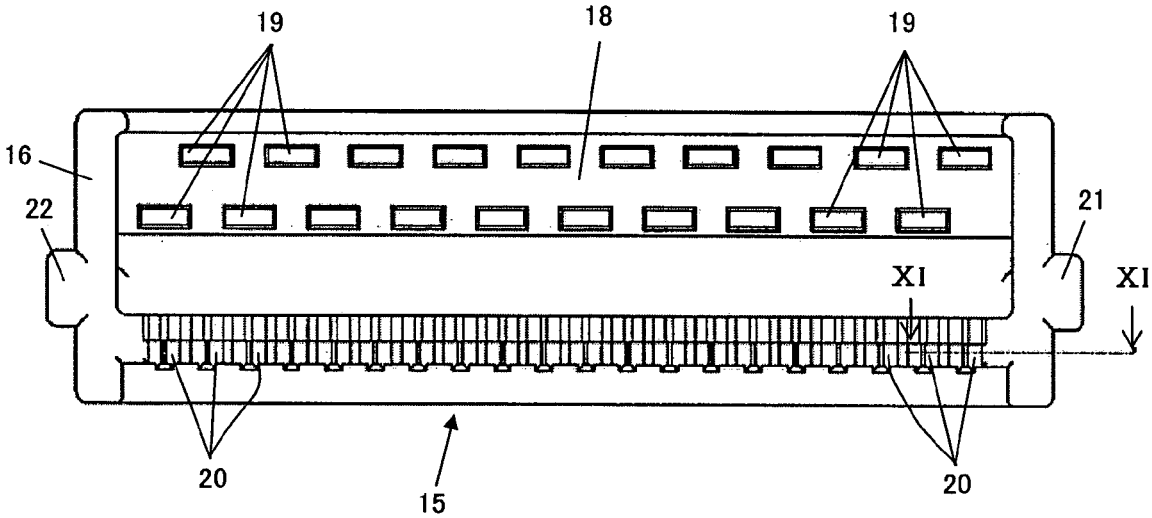
FIG. 9 is a schematic rear view showing another part of the embodiment of cable connector according to the present invention.
Figure 10:
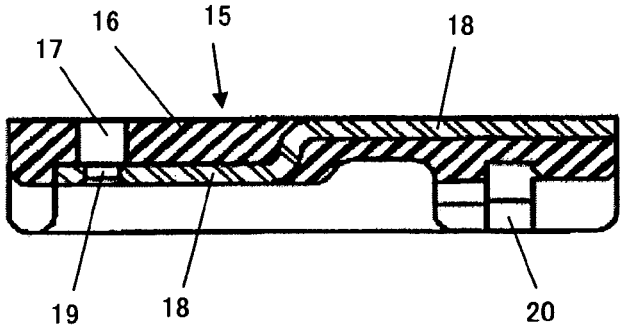
FIG. 10 is a schematic cross sectional view taken along line X-X in FIG. 7.

The body portion 16 of the cover member 15 is provided with a plurality of openings 17 which are disposed to correspond respectively to the transformable portions 13*c* of the ground conductive contact 13 when the cover member 15 is caused to engage with the housing 11. As shown in FIG. 10 representing a cross section along line X-X in FIG. 7, the body portion 16 of the cover member 15 is further provided with a metallic plate 18, a portion of which is buried in the body portion 16 by means of insert-molding. About one half of the metallic plate 18 forms a part of an outer surface (a surface shown in FIG. 7) of the cover member 15 and about another half of the metallic plate 18 forms a part of an inner surface (a surface shown in FIG. 9) of the cover member 15. Since the portion of the metallic plate 18 is thus buried in the body portion 16 of the cover member 15 by means of insert-molding, the metallic plate 18 has the effect of improving electrical shielding on the housing 11 for suppressing noise emission from the signal conductive contacts 12 and excluding outer noise, and is operative to strengthen the housing 11. The half of the metallic plate 18 forming the part of the inner surface of the cover member 15 is provided with a plurality of opening 19, as shown in FIG. 9. Each of the opening 19 has an aperture area smaller than that of the opening 17 provided on the body portion 16 of the cover member 15, as shown in FIG. 7.

Figure 11:
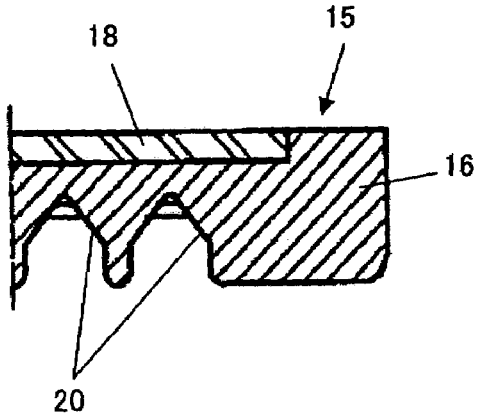
FIG. 11 is a schematic cross sectional view taken along line XI-XI in FIG. 9.

A plurality of grooves 20 arranged in parallel with one another are provided on the body portion 16 of the cover member 15 to appear at the inner surface of the cover member 15. These grooves 20 are disposed to correspond respectively to the transformable portions 12*a* of the signal conductive contacts 12 when the cover member 15 is caused to engage with the housing 11. As shown in FIG. 11 representing a cross section along line XI-XI in FIG. 9, a bottom portion of each of the grooves 20 is V-shaped in its cross section.

Figure 15:
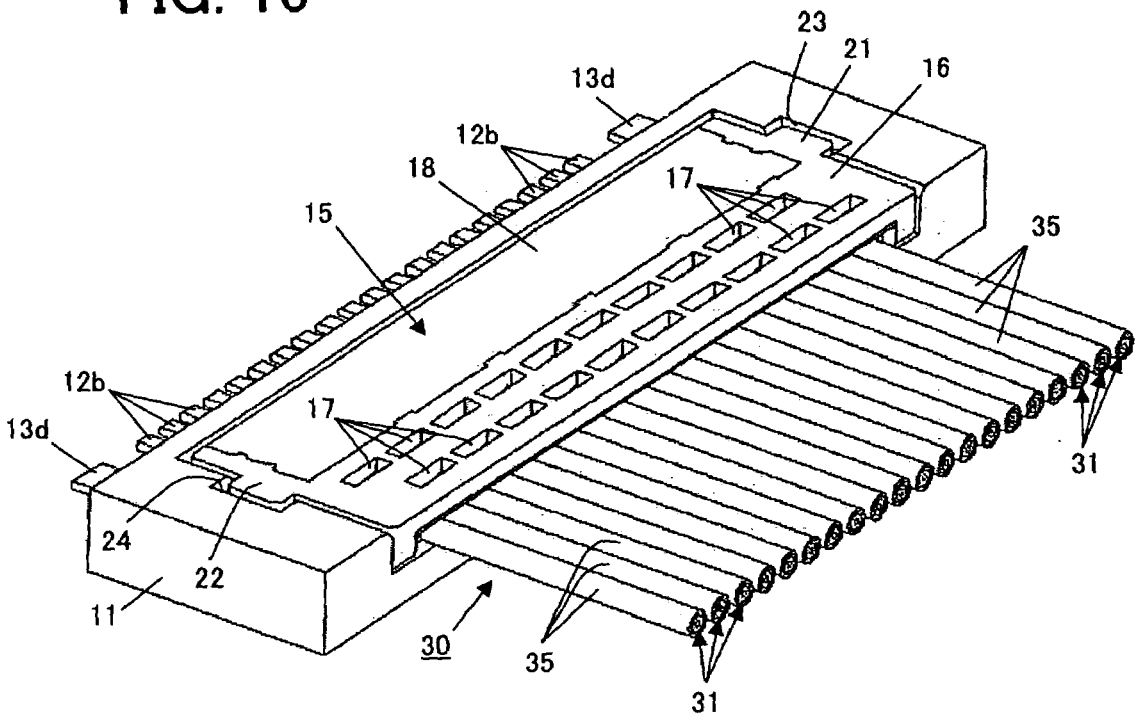

When the cover member 15 is caused to engage with the housing 11 to cover the transformable portions 12*a* of the signal conductive contacts 12 and the transformable portions 13*c* of the ground conductive contact 13, the cover member 15 is put in a condition (such a condition as shown in FIG. 15) wherein the inner surface of the cover member 15 faces the inside of the housing 11 and a pair of projections 21 and 22 each provided on an end portion of the cover member 15 in its longitudinal direction engage respectively with catching portions 23 and 24 (FIGS. 1 and 2) provided on the housing 11. Each of the grooves 20 provided on the body portion 16 of the cover member 15 to appear at the inner surface of the cover member 15 comes into contact with the transformable portion 12*a* of one of the signal conductive contacts 12 corresponding to that groove 20 and is operative to transform the transformable portion 12*a* of the corresponding one of the signal conductive contacts 12 to hold the core conductor of the coaxial cable in the condition of caulking connection. Further, each of the openings 19 provided on the metallic plate 18 and one of the openings 17 provided on the body portion 16 of the cover member 15 corresponding to that openings 19 engage with one of the transformable portions 13*c* of the ground conductive contact 13 corresponding to that openings 19 and 17 and are operative to transform the corresponding one of the transformable portions 13*c* of the ground conductive contact 13 to hold the outer conductor of the coaxial cable in the condition of caulking connection.

The transformable portion 12*a* of each of the signal conductive contacts 12 is moved by the groove 20 in a direction along the linear arrangement of the transformable portions 12*a* of the signal conductive contacts 12 for transforming to hold the core conductor of the coaxial cable in the condition of caulking connection. Similarly, each of the transformable portions 13*c* of the ground conductive contacts 13 is moved by the openings 19 and 17 in a direction along the linear arrangement of the transformable portions 13*c* of the ground conductive contacts 13 for transforming to hold the outer conductor of the coaxial cable in the condition of caulking connection. Since the linear arrangement of the transformable portions 12*a* of the signal conductive contacts 12 is substantially parallel with the linear arrangement of the transformable portions 13*c* of the ground conductive contacts 13, the direction of the transforming movement of the transformable portion 12*a* for holding the core conductor of the coaxial cable in the condition of caulking connection is substantially parallel with the direction of the transforming movement of the transformable portion 13*c* for holding the outer conductor of the coaxial cable in the condition of caulking connection.

As described above, each of the openings 19 provided on the metallic plate 18 and one of the openings 17 provided on the body portion 16 of the cover member 15 corresponding to that openings 19 engage with one of the transformable portions 13*c* of the ground conductive contact 13 corresponding to those openings 19 and 17 when the cover member 15 is caused to engage with the housing 11 for covering the transformable portions 12*a* of the signal conductive contacts 12 and the transformable portions 13*c* of the ground conductive contact 13. In this operation, hook-shaped protrusions 13*e*

Figure 21:
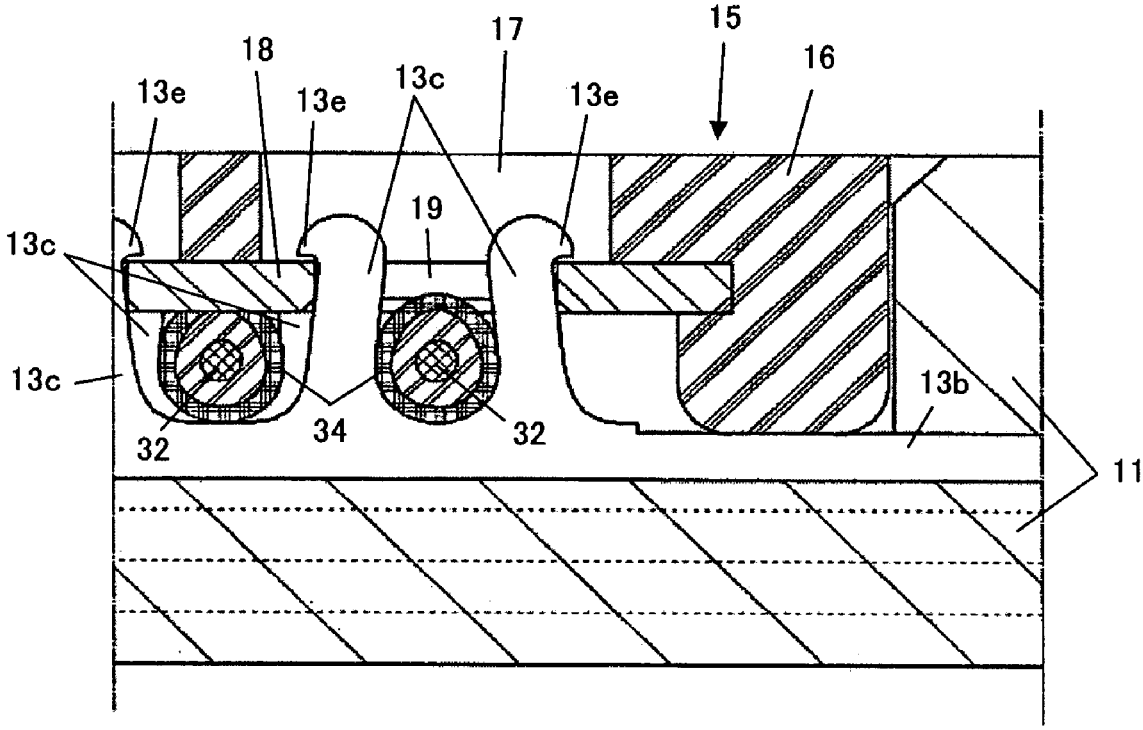

(FIG. 3) provided on each of the transformable portions 13*c* of the ground conductive contact 13 are locked with the opening 17 (as shown in FIG. 21), so that the cover member 15 engaging with the housing 11 to cover the transformable portions 12*a* of the signal conductive contacts 12 and the transformable portions 13*c* of the ground conductive contact 13 is fastened on the housing 11.

The embodiment of method of connecting a cable with a cable connector according to the present invention, which comprises substantially first and second steps, is carried out with the above described embodiment of cable connector according to the present invention.

Figure 12:
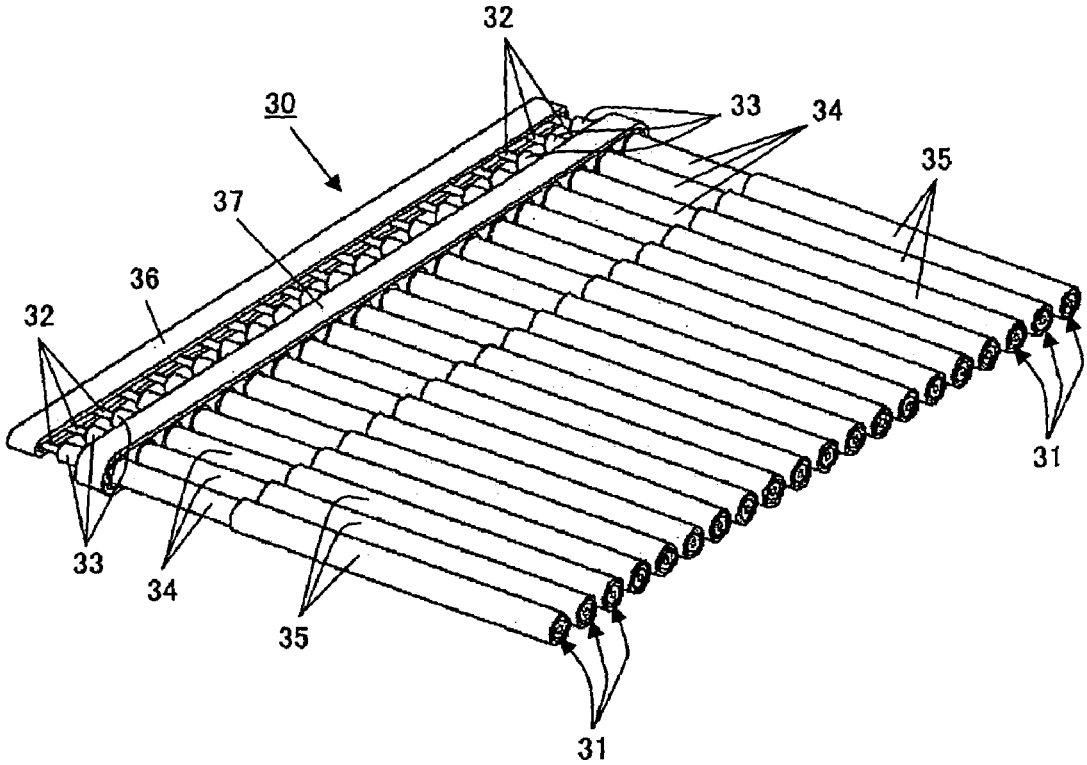
FIG. 12 is a schematic perspective view showing a cable aggregate used in an embodiment of method of connecting a cable with a cable connector according to the present invention.

In the embodiment of method according to the present invention, a cable aggregate 30 as shown in FIG. 12, which in to be connected electrically with the embodiment of cable connector according to the present invention, is prepared. The cable aggregate 30 is constituted with a plurality of coaxial cables 31 arranged in parallel with one another to be flat.

Each of the coaxial cables 31 constituting the cable aggregate 30 has a core conductor 32, an inner insulating layer 33 surrounding the core conductor 32, an outer conductor 34 surrounding the inner insulating layer 33 and an insulating cover 35 surrounding the outer conductor 34. At a portion close to an end portion of each of the coaxial cables 31, the insulating cover 35 is partially removed for baring a portion of the outer conductor 34 to be exposed to the outside. Then, at the end portion of the each of the coaxial cables 31, a part of an end portion of the insulating cover 35 and a part of an end portion of the outer conductor 34 are removed for baring an end portion of the inner insulting layer 33 to be exposed to the outside. Further, in the end portion of each of the coaxial cables 31 wherein the end portion of the inner insulting layer 33 is exposed to the outside, a part of the end portion of the inner insulating layer 33 is removed for baring an end portion of the core conductor 32 to be exposed to the outside.

The coaxial cables 31, each of which has the core conductor 32 exposed partially to be the outside and the outer conductor 34 also exposed partially to the outside, are caused to maintain the arrangement made to be flat with a band 36 for bundling the end portions of the core conductors 32 of the coaxial cables 31 and a band 37 for bundling the portions close to the end portions of the coaxial cables 31.

Figure 13:
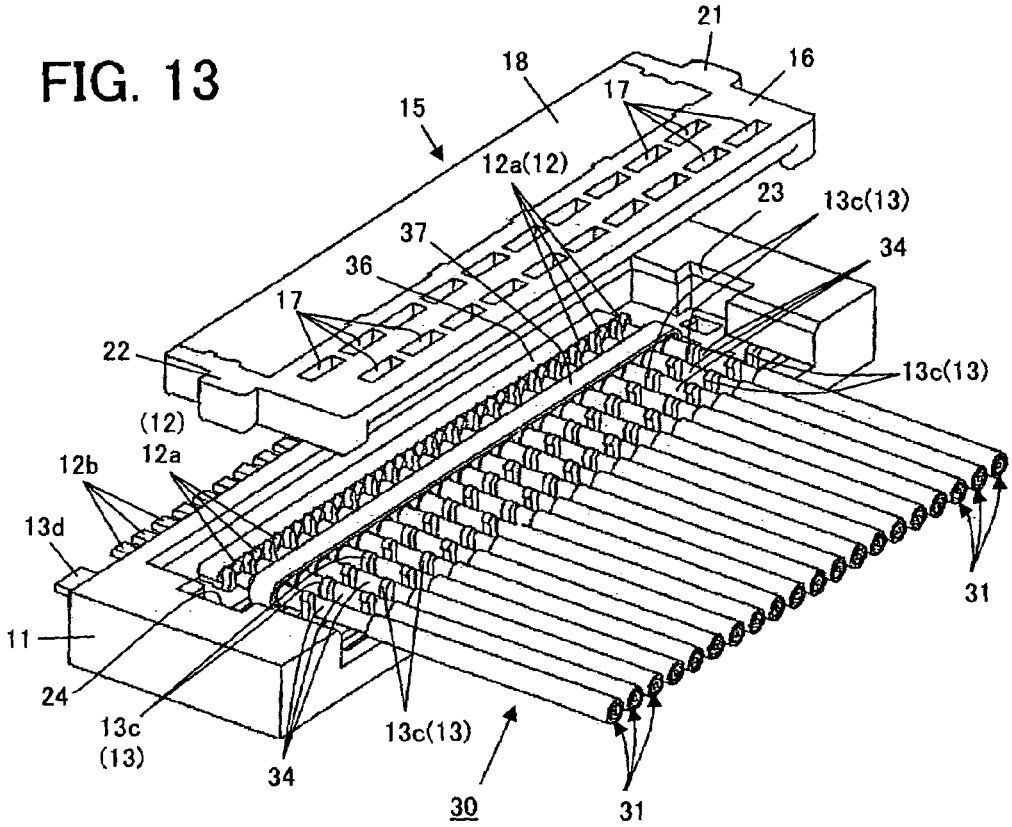
FIGS. 13, 14 and 15 are schematic perspective views used for explaining steps of the embodiment of method according to the present invention.
Figure 14:
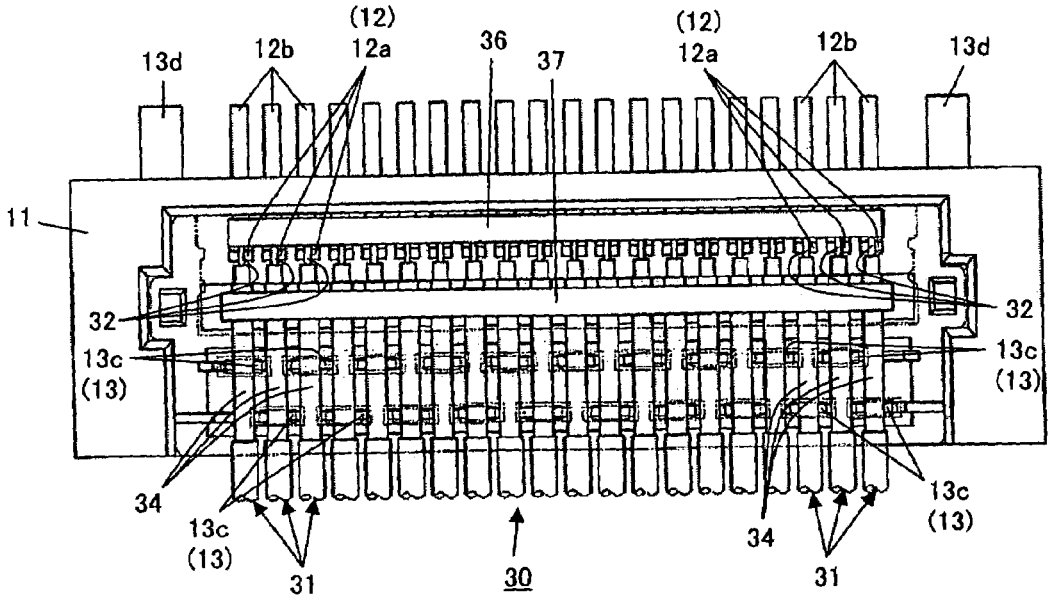

Then, the embodiment of cable connector according to the present invention is subjected to the first step of putting the core and outer conductors 32 and 34 of the coaxial cable 31 respectively on the transformable portion 12*a* of the signal conductive contact 12 and the transformable portion 13*c* of the ground conductive contact 13 provided in the housing 11 of the embodiment of cable connector according to the present invention. In the first step, the end portion of the core conductor 32 of each of the coaxial cables 31 constituting the cable aggregate 30, which is exposed to the outside, is put on a corresponding one of the transformable portions 12*a* of the signal conductive contacts 12 arranged in the housing 11, and the portion of the outer conductor 34 of each of the coaxial cables 31, which is also exposed to the outside, is put on a corresponding one of the transformable portions 13*c* of the ground conductive contacts 13 arranged in the housing 11, as shown in FIGS. 13 and 14. The operations for putting the end portion of the core conductor 32 and the portion of the outer conductor 34 of each of the coaxial cables 31 on the corresponding one of the transformable portions 12*a* and the corresponding one of the transformable portions 13*c*, respectively, are simultaneously carried out easily by means of positioning the cable aggregate 30 on the housing 11 so that the cable aggregate 30 comes into contact with the housing 11.

Thereby, such a condition as shown in FIGS. 13 and 14, in which the core conductor 32 and outer conductor 34 of each of the coaxial cables 31 constituting the cable aggregate 30 are caused to engage respectively with the transformable portion 12*a* of the signal conductive contact 12 and the transformable portion 13*c* of the ground conductive contact 13 in the housing 11, is surely obtained.

Next, the embodiment of cable connector according to the present invention, on the housing 11 of which the cable aggregate 30 is positioned, is subjected to the second step of causing the cover member 15 to engage with the housing 11 of the embodiment of cable connector according to the present invention. In the second step, the cover member 15, as shown in FIG. 13, is caused to engage with the housing 11 to cover the transformable portions 12*a* of the signal conductive contacts 12 and the transformable portions 13*c* of the ground conductive contact 13 provided in the housing. On this occasion, the cover member 15 is put in a condition wherein the inner surface of the cover member 15 faces the inside of the housing 11 and the projections 21 and 22 each provided on an end portion of the cover member 15 in its longitudinal direction engage respectively with the catching portions 23 and 24 provided on the housing 11, as shown in FIG. 15.

Figure 16:
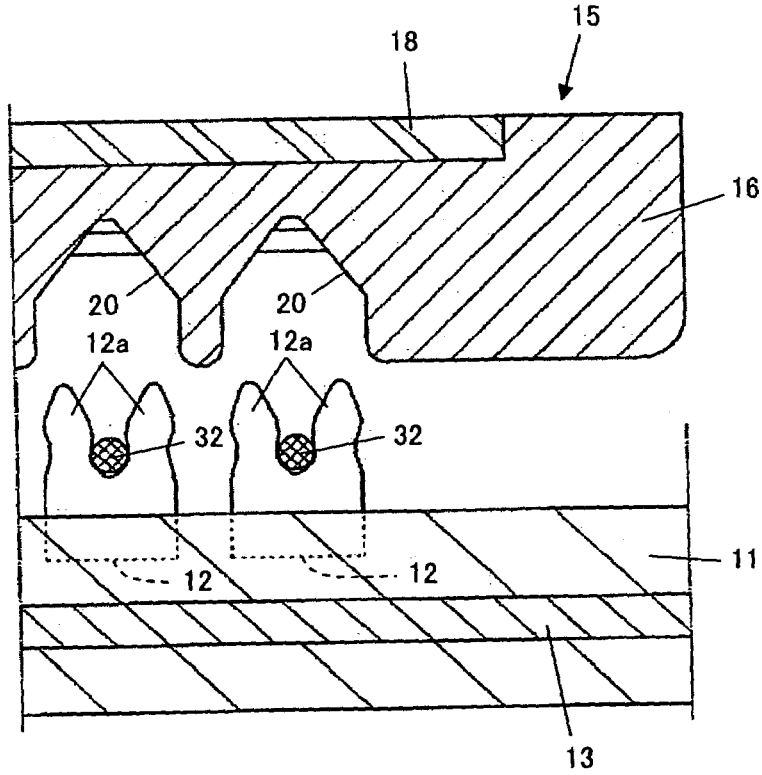
FIGS. 16 to 21 are schematic partial cross sectional views used for explaining practical steps of the embodiment of method according to the present invention.
Figure 17:
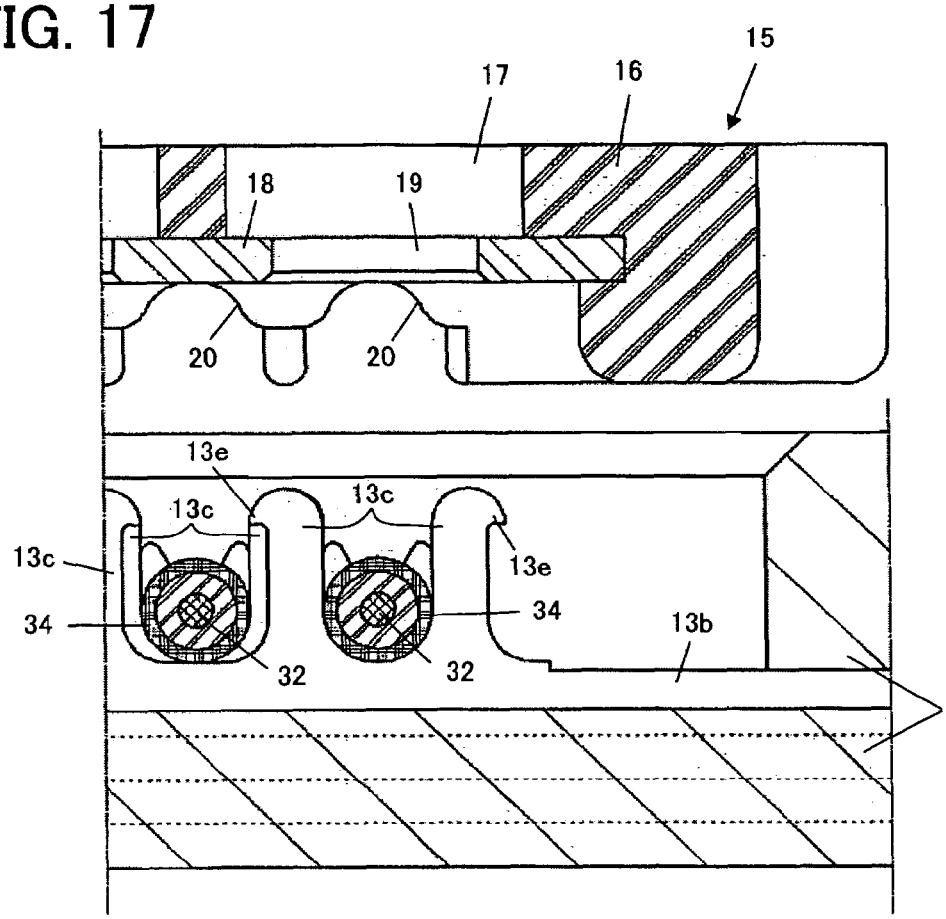

When the cover member 15 is caused to engage with the housing 11 of the embodiment of cable connector according to the present invention as described above, at the initial stage, each of the grooves 20 provided on the body portion 16 of the cover member 15 to appear at the inner surface of the cover member 15 is disposed to correspond to the transformable portion 12*a* of one of the signal conductive contacts 12 corresponding to that groove 20, as shown in FIG. 16, and each of the openings 19 provided on the metallic plate 18 and one of the openings 17 provided on the body portion 16 of the cover member 15 corresponding to that openings 19 are disposed to correspond to one of the transformable portions 13*c* of the ground conductive contact 13 corresponding to those openings 19 and 17, as shown in FIG. 17.

Figure 18:
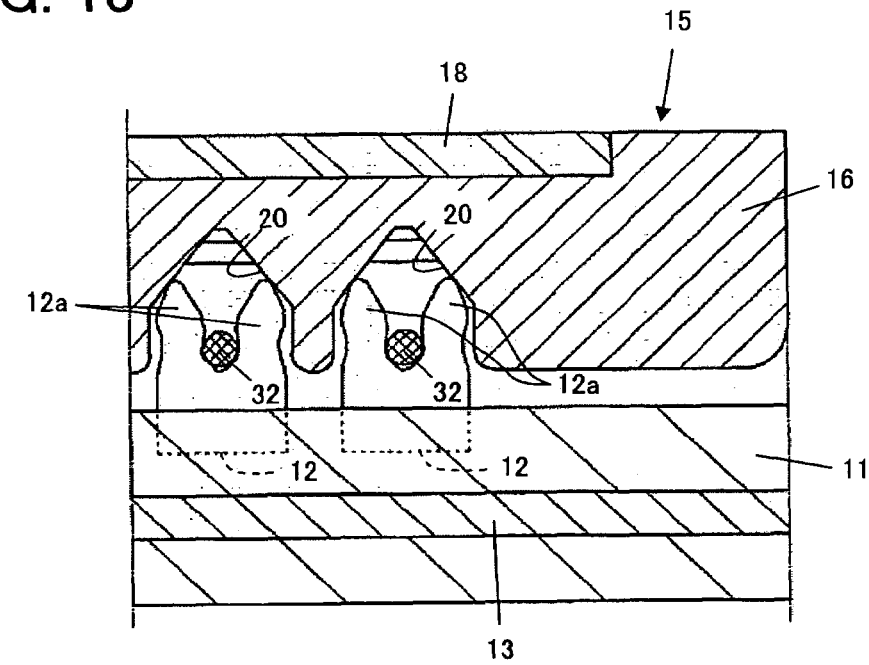
Figure 19:
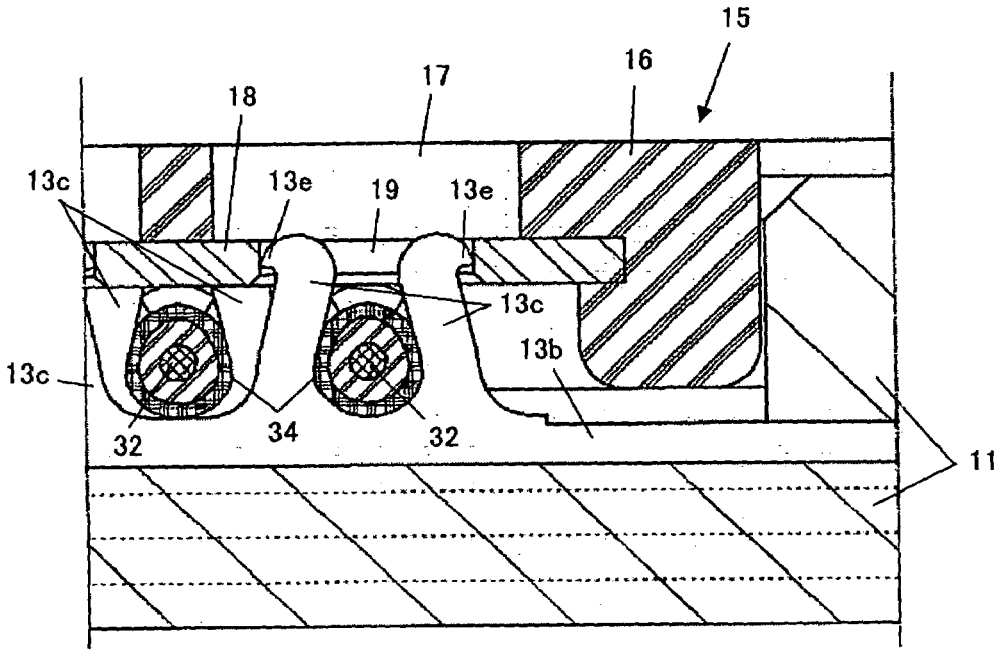

Then, the cover member 15 is pushed toward the inside of the housing 11, so that each of the grooves 20 provided on the body portion 16 of the cover member 15 to appear at the inner surface of the cover member 15 comes into contact with the transformable portion 12*a* of the corresponding one of the signal conductive contacts 12, with which the core conductor 32 of the coaxial cable 31 is engages, as shown in FIG. 18, and each of the openings 19 provided on the metallic plate 18 of the cover member 15 and one of the openings 17 provided on the body portion 16 of the cover member 15 corresponding to that openings 19 engage with the corresponding one of the transformable portions 13*c* of the ground conductive contact 13, with which the outer conductor 34 of the coaxial cable 31 is already engages, as shown in FIG. 19.

Figure 20:
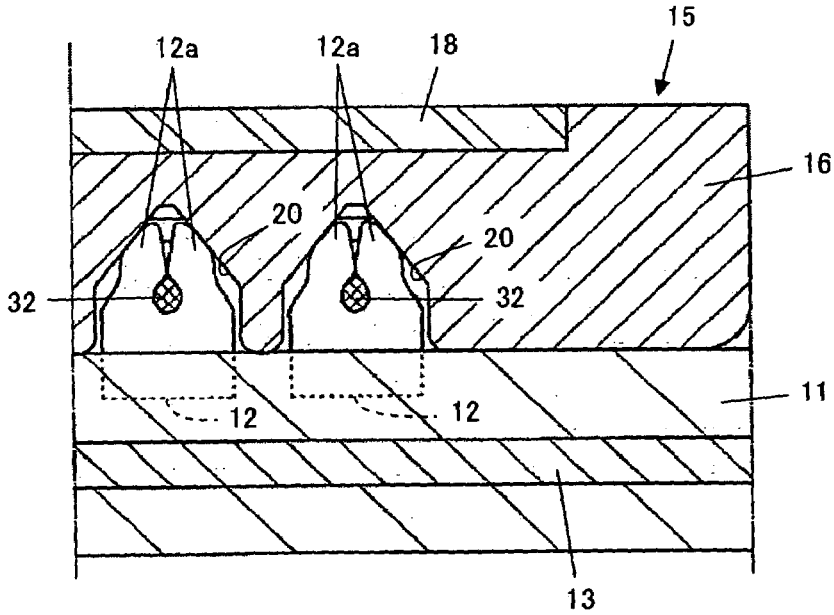

After that, when the cover member 15 is further pushed toward the inside of the housing 11 to engage completely with the housing 11, each of the grooves 20 provided on the body portion 16 of the cover member 15 to appear at the inner surface of the cover member 15 is operative to transform the transformable portion 12*a* of the corresponding one of the signal conductive contacts 12 to hold the core conductor 32 of the coaxial cable 31 in the condition of caulking connection, as shown in FIG. 20, and each of the openings 19 provided on the metallic plate 18 of the cover member 15 and one of the openings 17 provided on the body portion 16 of the cover member 15 corresponding to that openings 19 are operative to transform the corresponding one of the transformable portions 13*c* of the ground conductive contact 13 to hold the outer conductor 34 of the coaxial cable 31 in the condition of caulking connection, as shown in FIG. 21. Thereby, the core conductors 32 and the outer conductor 34 of each of the coaxial cables 31 constituting the cable aggregate 30 are held in the condition of caulking connection respectively by the transformable portion 12*a* of the corresponding one of the signal conductive contacts 12 and the corresponding one of the transformable portions 13*c* of the ground conductive contact 13.

Further, when the opening 19 provided on the metallic plate 18 of the cover member 15 and the opening 17 provided on the body portion 16 of the cover member 15 engage with the transformable portion 13*c* of the ground conductive contact 13, the hook-shaped protrusions 13*e* provided on the transformable portions 13*c* of the ground conductive contact 13 are locked with the openings 19 provided on the metallic plate 18 of the cover member 15. With such a lock of the hook-shaped protrusions 13*e* with the openings 19, the cover member 15 engaging with the housing 11 for covering the transformable portions 12*a* of the signal conductive contacts 12 and the transformable portions 13*c* of the ground conductive contact 13 is fastened surely on the housing 11.

The deformation of the transformable portion 12*a* of each of the signal conductive contacts 12 for holding the core conductor 32 of the coaxial cable 31 in the condition of caulking connection and the deformation of each of the transformable portions 13*c* of the ground conductive contact 13 for holding the outer conductor 34 of the coaxial cable 31 in the condition of caulking connection, as mentioned above, are simultaneously carried out easily by means of causing the cover member 15 to engage with the housing 11 of the embodiment of cable connector according to the present invention.

Accordingly, with the embodiment of method of connecting a cable with a cable connector according to the present invention, the cable aggregate 30 can be connected electrically with the embodiment of cable connector according to the present invention surely and securely with relatively simple operations without soldering in such a manner that the core and outer conductors 32 and 34 of each of the coaxial cables 31 constituting the cable aggregate 30 are simultaneously connected respectively with the signal and ground conductive contacts 12 and 13 in the housing 11 of the embodiment of cable connector according to the present invention by causing the cover member 15 to engage with the housing 11, wherein the core conductor 32 of each of the coaxial cables 31 is connected with the signal conductive contact 12 with the transformable portion 12*a* of the signal conductive contact 12 which is transformed by the cover member 15 to hold the core conductor 32 in the condition of caulking connection and the outer conductor 34 of each of the coaxial cables 31 is connected with the ground conductive contact 13 with the transformable portion 13*c* of the ground conductive contact 13 which is also transformed by the cover member 15 to hold the outer conductor 34 in the condition of caulking connection.

Although, in the embodiment of cable connector described above, the coaxial cables 31 are connected with the signal and ground conductive contacts 12 and 13 provided in the housing 11, it is also possible to design the cable connector according to the present invention so as to have signal and ground conductive contacts with which a single coaxial cable is connected. Further, although, with the embodiment of method described above, the coaxial cables 31 are connected with the signal and ground conductive contacts 12 and 13 provided in the housing 11 of the embodiment of cable connector according to the present invention, it should be understood that the method of connecting a coaxial cable with a cable connector according to the present invention can be applied for connecting a single coaxial cable with signal and ground conductive contacts provided in a cable connector.

In addition, although, in the embodiment of cable connector described above, each of the metallic plate 18, which has the portion thereof buried in the body portion 16 of the cover member 15 by means of insert-molding, and the ground conductive contact 13, which has the portion thereof buried in the housing 11 by means of insert-molding, have the effect of improving electrical shielding on the housing 11 for suppressing noise emission from the signal conductive contacts 12 and excluding outer noise, it is also possible to design the cable connector according to the present invention so as to have a metallic shell covering the same in its entirety for bringing about electrical shielding.

What is claimed is:

1. A cable connector comprising;

a housing made of insulating material, a signal conductive contact provided in said housing and having a first transformable portion formed of at least two transformable members for holding a core conductor of a coaxial cable between said transformable members in a condition of caulking connection, a ground conductive contact provided in said housing and having a second transformable portion formed of at least two transformable members for holding an outer conductor of the coaxial cable between said transformable members in a condition of caulking connection, and a cover member for engaging with said housing to cover the first transformable portion of said signal conductive contact and the second transformable portion of said ground conductive contact and operating to move at least one of the transformable members of the first transformable portion of said signal conductive contact toward the other of the transformable members of the first transformable portion so as to hold the core conductor of the coaxial cable in the condition of caulking connection and to move at least one of the transformable members of the second transformable portion of said ground conductive contact toward the other of the transformable members of the second transformable portion so as to hold the outer conductor of the coaxial cable in the condition of caulking connection.

2. The cable connector according to claim 1, wherein a direction of transforming movement of the at least one of the transformable members of the first transformable portion of said signal conductive contact for holding the core conductor of the coaxial cable in the condition of caulking connection is substantially parallel with a direction of transforming movement of the at least one of the transformable members of the second transformable portion of said ground conductive contact for holding the outer conductor of the coaxial cable in the condition of caulking connection.

3. The cable connector according to claim 1, wherein said cover member has a groove disposed to correspond to the first transformable portion of said signal conductive contact and an opening disposed to correspond to the second transformable portion of said ground conductive contact, and said groove is operative to transform the first transformable portion of said signal conductive contact for holding the core conductor of the coaxial cable in the condition of caulking connection and said opening is operative to transform the second transformable portion of said ground conductive contact for holding the outer conductor of the coaxial cable in the condition of caulking connection when said cover member is caused to engage with said housing to cover the first transformable portion of said signal conductive contact and the second transformable portion of said ground conductive contact.

4. The cable connector according to claim 3, wherein said opening of said cover member engages with the second transformable portion of said ground conductive contact so that said cover member is fastened on said housing when said cover member is caused to engage with said housing for covering the first transformable portion of said signal conductive contact and the second transformable portion of said ground conductive contact.

5. The cable connector according to claim 3, wherein said cover member is provided with a metallic plate having a portion thereof buried in said cover member by means of insert-molding.

6. The cable connector according to claim 1, wherein said ground conductive contact has a portion thereof buried in said housing by means of insert-molding.

7. A method of connecting a cable with a cable connector, which comprises the steps of;

putting core and outer conductors of a coaxial cable respectively on a first transformable portion of a signal conductive contact formed of at least two transformable members and a second transformable portion of a ground conductive contact formed of at least two transformable members provided in a housing of a cable connector, and causing a cover member to engage with the housing of the cable connector to cover the first transformable portion of the signal conductive contact and the second transformable portion of the ground conductive contact and to be operative to move at least one of the transformable members of the first transformable portion of the signal conductive contact toward the other of the transformable members of the first transformable portion for holding the core conductor of the coaxial cable in a condition of caulking connection and to move at least one of the transformable members of the second transformable portion of the ground conductive contact toward the other of the transformable members of the second transformable portion for holding the outer conductor of the coaxial cable in a condition of caulking connection, so that the core and outer conductors of the coaxial cable are electrically connected respectively with the signal and ground conductive contacts of the cable connector.

8. The method according to claim 7, wherein said cover member has a groove disposed to correspond to the first transformable portion of the signal conductive contact and an opening disposed to correspond to the second transformable portion of the ground conductive contact, and said groove is caused to move at least one of the transformable members of the first transformable portion of the signal conductive contact for holding the core conductor of the coaxial cable in the condition of caulking connection and said opening is caused to move at least one of the transformable members of the second transformable portion of the ground conductive contact for holding the outer conductor of the coaxial cable in the condition of caulking connection when said cover member is caused to engage with said housing to cover the first transformable portion of the signal conductive contact and the second transformable portion of the ground conductive contact.

9. The method according to claim 8, wherein said opening of said cover member is caused to engage with the second transformable portion of the ground conductive contact so that said cover member is fastened on the housing when said cover member is caused to engage with the housing for covering the first transformable portion of the signal conductive contact and the second transformable portion of the ground conductive contact.

* * * * *